US006810933B2

(12) United States Patent
Gordon et al.

(10) Patent No.: US 6,810,933 B2
(45) Date of Patent: Nov. 2, 2004

(54) CRAFTER'S PURSE

(76) Inventors: Terri L. Gordon, 2500 Stone Creek Way, Mount Dora, FL (US) 32757; Michael L. Gordon, 2500 Stone Creek Way, Mount Dora, FL (US) 32757

( * ) Notice: Subject to any disclaimer, the term of this patent is extended or adjusted under 35 U.S.C. 154(b) by 41 days.

(21) Appl. No.: 10/247,445

(22) Filed: Sep. 20, 2002

(65) Prior Publication Data

US 2004/0055679 A1 Mar. 25, 2004

(51) Int. Cl.[7] ..... A45C 1/02

(52) U.S. Cl. ..... 150/112; 150/107; 383/28; 383/29

(58) Field of Search ..... 383/71, 42, 43, 383/78, 93, 8, 11, 13, 15, 28, 29; 150/112, 113, 118, 124, 107, 110, 103, 104

(56) References Cited

U.S. PATENT DOCUMENTS 4,738,547 A * 4/1988 Brown ..... 383/39
D334,839 S * 4/1993 Dancyger ..... D3/303
5,653,337 A 8/1997 Cirigliano
5,813,445 A 9/1998 Christman
6,085,902 A 7/2000 Fang
6,186,662 B1 * 2/2001 Jackson ..... 383/16
6,237,533 B1 * 5/2001 Rodriguez ..... 119/161
6,286,798 B1 * 9/2001 Chun ..... 248/311.2
D456,991 S * 5/2002 Achache ..... D3/233
6,595,687 B2 * 7/2003 Godshaw et al. ..... 383/6

* cited by examiner

*Primary Examiner*—Tri M. Mai
(74) *Attorney, Agent, or Firm*—Richard C. Litman

(57) ABSTRACT

A crafter's purse is adapted for the storage, display, accessing, and carrying of crafter's tools. The crafter's purse has a generally rectangular bottom panel and an upright peripheral panel extending about the periphery of the bottom panel for forming a container having an open end. At least one exterior panel is attached to the exterior surface of the peripheral panel to form a plurality of exterior pockets for containing and displaying additional items. The crafter's purse has a pair of handles for carrying the crafter's purse and an elastic band which encircles the peripheral wall at a position above the pocket openings to secure the items contained in the pockets. At least one additional pocket may be attached to the interior surface of the peripheral wall for forming an internal pocket.

5 Claims, 3 Drawing Sheets

CRAFTER'S PURSE

BACKGROUND OF THE INVENTION

1. Field of the Invention

The present invention relates to a crafter's purse, and particularly to a crafter's purse providing a tote bag adapted for storage, display, accessing, and carrying of crafter's tools.

2. Description of the Related Art

Crafter's tools are typically stored in tool bags or purses to facilitate transportation of the tools to a desired location. However, a conventional crafter's tote bag is not effective in keeping the tools segregated, as it allows the tools to freely intermingle in the tote bag. Many times, the entire contents of the bag must be removed from the bag to be displayed in a manner which would facilitate selecting and retrieving the desired tools. After an activity is completed, the tools must be gathered and packed in the bag. Consequently, the procedure of selecting a desired tool from a conventional crafter's tote bag can become difficult and time consuming.

Various tool bags have attempted to remedy the problems associated with conventional bags by providing fold-out individual storage compartments, such as pockets or pouches on an interior wall. Generally, however, these bags do not provide adequate display of the items contained therein, as the pockets are positioned inside the bag. Other bags have storage compartments on an exterior surface which allow the tools to be displayed, however, they fail to prevent the tools from falling out of the pockets or enclosures. Conventional bags also lack a rigid support at their base to support the structure of the bag on a horizontal support surface.

U.S. Pat. No. 5,653,337, issued Aug. 5, 1997 to C. Cirigliano, describes a reversible tote bag of foldable construction for containing workmen's tools having a reversible folding wall with a reversible closure adapted to be changeable into multiple positions for ease of use and access. A unitary container panel is closable to form a tote bag, openable to allow access thereto and reversible permitting the tote bag to be turned inside out.

U.S. Pat. No. 6,085,902, issued Jul. 11, 2000 to L. Fang, describes a tote bag which can alternatively be used in connection with an empty container, such as a five-gallon bucket, for the transport and storage of larger articles. The inner and outer skirt-like walls of the apparatus are provided with pockets which are adapted to receive and organize hand tools. Zipper mechanisms interconnect the lower margins of the outer skirt-like walls to convert the apparatus from a bucket organizer into a tote bag.

U.S. Pat. No. 5,813,445, issued Sep. 29, 1998 to L. Christman, describes a bingo tote bag having interior and exterior compartments. The interior space of the bingo tote bag is large enough for carrying additional items.

None of the above inventions and patents, taken either singly or in combination, is seen to describe the instant invention as claimed. Thus a crafter's purse solving the aforementioned problems is desired.

SUMMARY OF THE INVENTION

A crafter's purse is adapted for the storage, display, accessing, and carrying of crafter's tools. The crafter's purse has a generally rectangular bottom panel and an upright peripheral panel extending about the periphery of the bottom panel for forming a container having an open end. The bottom panel is capable of supporting the structure of the bag on a horizontal support surface. The peripheral panel includes a pair of opposing, parallel side walls which extend between and connect opposing, parallel end walls. A detachable fastening strap extends across the open end and attaches to opposing side walls at either end to secure items contained within the crafter's purse. An exterior panel is attached to the exterior surface of each side wall and each end wall to form a plurality of exterior pockets for containing and displaying additional items. Also attached to opposing side walls are a pair of handles for carrying the crafter's purse. An elastic band encircles the peripheral wall at a position above the pocket openings to secure the items contained in the pockets. At least one additional pocket may be attached to the interior surface of the peripheral wall for forming an internal pocket.

Accordingly, it is a principal object of the invention to provide a crafter's purse in which crafter's tools may be stored.

It is another object of the invention to provide a crafter's purse in which crafter's tools may be transported.

It is a further object of the invention to provide a crafter's purse in which crafter's tools may be displayed.

Still another object of the invention is to provide a crafter's purse which allows tools contained therein to remain segregated and secured to the purse.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
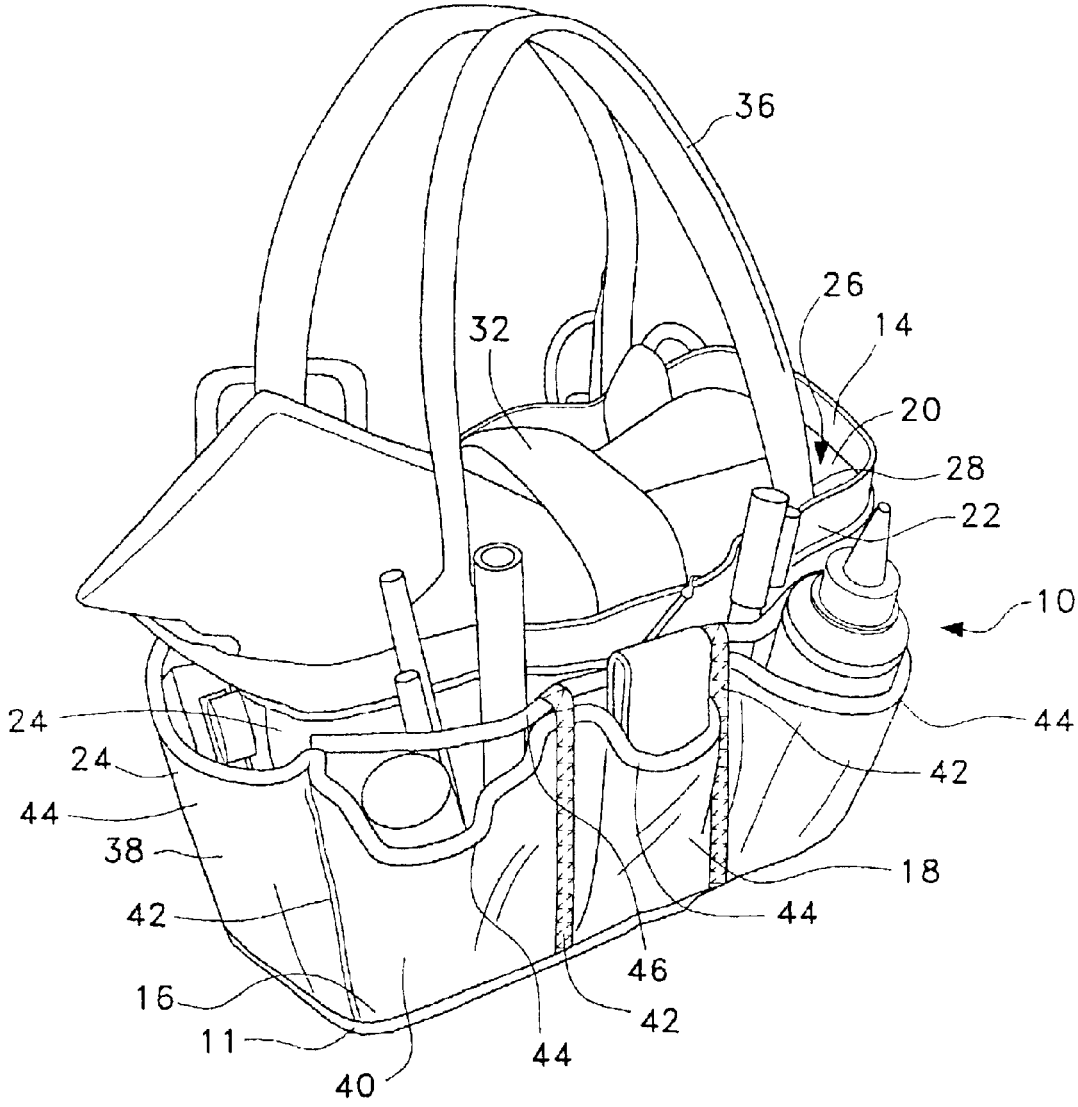
FIG. 1 is an environmental, perspective view of a crafter's purse according to the present invention with tools contained therein.
Figure 2:
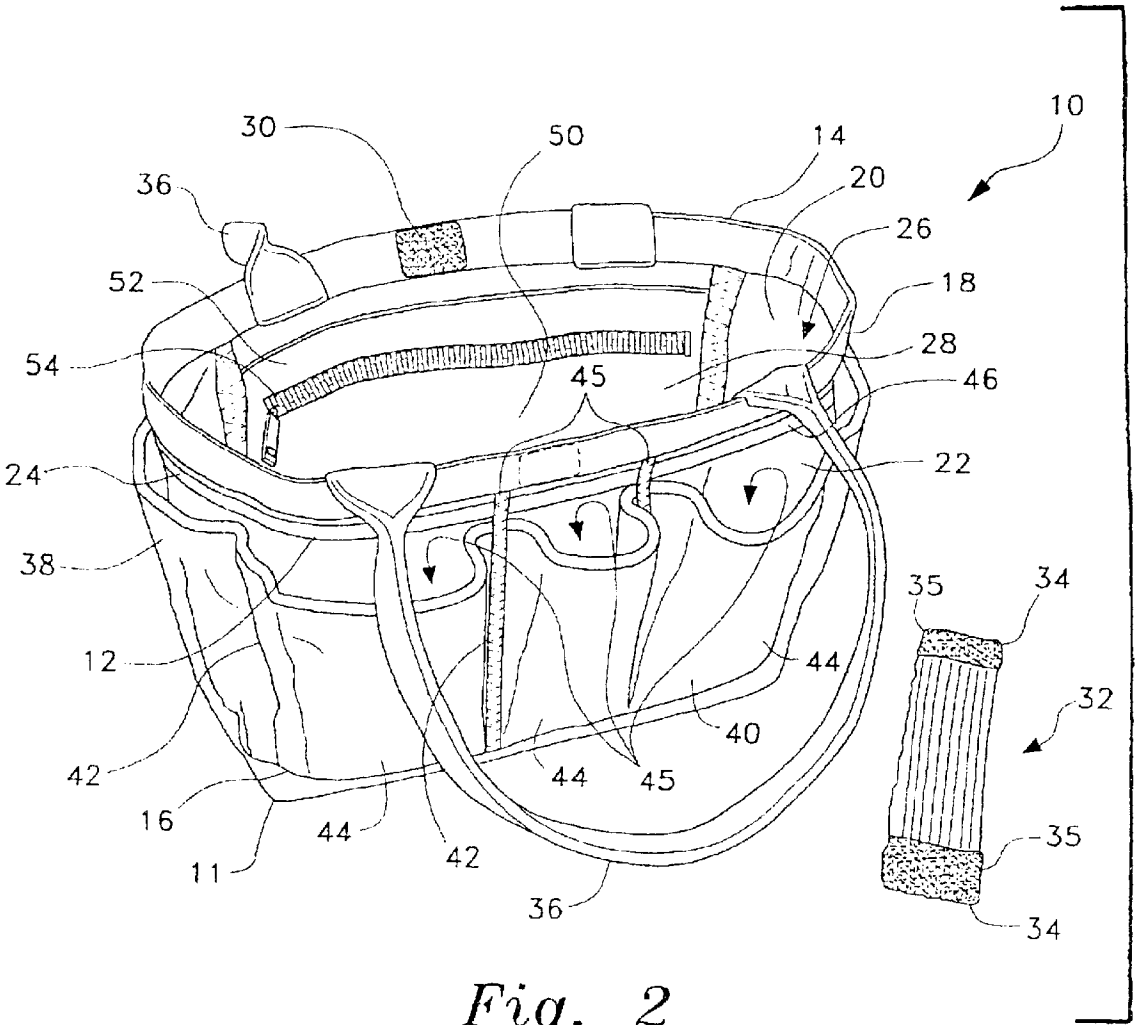
FIG. 2 is a perspective view of a crafter's purse according to the present invention exploded to show the with detachable strap unattached.
Figure 3:
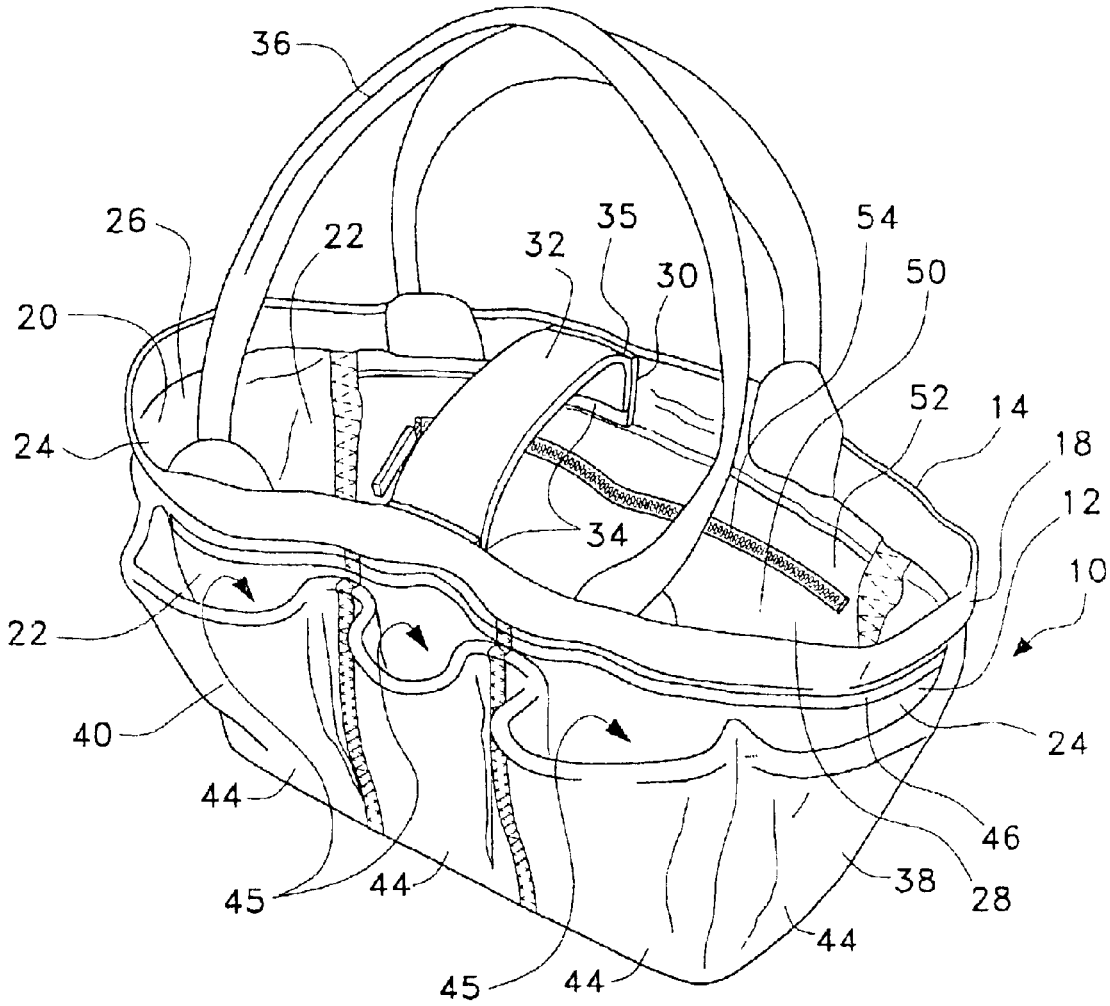
FIG. 3 is a perspective view of a crafter's purse according to the present invention with the detachable strap attached.

The present invention relates to a crafter's purse, designated generally as 10 in the drawings. As can be seen in FIGS. 1–3, the crafter's purse has a generally rectangular bottom panel 11 and an upright peripheral panel 12 extending about the periphery of the bottom panel 11. The peripheral panel 12 has a top portion 14, a bottom portion 16, an exterior surface 18, and an interior surface 20. As can be seen more clearly in FIGS. 2–3, the bottom panel 11 in combination with the peripheral panel 12 form a container or bag having one open end 28 at the top portion 14 and having an interior compartment area 26 for storing items such as crafter's tools. Preferably, the bottom panel 11 is doubly layered, or comprises a double layer of the material from which the purse 10 is made, in order to support the structure of the purse 10 on a horizontal support surface. The crafter's purse 10 is constructed from fabric, vinyl, leather, or other suitable material, having the components attached together by sewing, double stitching, adhesively or by any other suitable manner. Preferably the crafter's purse 10 is made from canvas and the component parts are stitched together.

As depicted in FIGS. 2–3, the peripheral panel 12 is defined by a pair of opposing, parallel side walls 22 which extend between and connect opposing, parallel end walls 24. The bottom panel, the side walls and the end walls may be integrally formed or formed from separate pieces. A patch of hook-and-loop fastening material 30 is attached to the interior surface 20 of the opposing side walls 22 at corresponding positions. The respective mating patches 35 for each patch 30 of hook and loop fastening material are affixed to opposing ends 34 of a detachable fastening strap 32. The detachable fastening strap 32 extends across the open end 28 and attaches at its opposing ends 34 to the patches 30 of hook-and-loop fastening material affixed to the side walls 22. A handle 36 is attached on the interior surface 20 of each opposing side wall 22 at corresponding positions of the top portion 14.

An exterior end panel 38 and an exterior side panel 40 are attached to the exterior surface 18 of each end wall 24 and each side wall 22 respectively at attachment points 42 for forming exterior pockets 44. Preferably, the exterior end panel 38 and side panels 40 are stitched to the peripheral wall 12 only partially around their peripheries to form a mouth portion 45 facing the top portion 14 of the peripheral panel 12. Each exterior side panel 40 is then stitched intermittently and in spaced apart relation to the side wall at additional attachment points 42 to form additional exterior pockets 44 on both side walls 22 of the crafter's purse 10. Preferably, three exterior pockets 44 are formed on each side wall 22. The exterior end panel 38 and the exterior side panels 40 can be integrally formed or formed from separate pieces.

A fastening band 46 made from an elastic fabric or any other suitable, resilient material encircles the peripheral panel at position above the mouth portion 45 of each exterior pocket 44 to further secure items contained in each exterior pocket 44. The band 46 is stitched or otherwise attached to the end panels 38 and side panels 40 in a spaced apart fashion, corresponding with attachment points 42.

An interior pocket 50 may be formed by attaching together two separate pieces of fabric or other material such that an envelope enclosure is formed having a flap 52. One interior pocket 50 is then attached to the interior surface 20 of one or both side walls 22. The flap 52 may be secured by a conventional zipper apparatus 54, or any other suitable fastening means.

It is to be understood that the present invention is not limited to the embodiment described above, but encompasses any and all embodiments within the scope of the following claims.

We claim:

1. A purse for storing, displaying, accessing and carrying craft tools, comprising:

a generally rectangular bottom panel;

an upright peripheral panel extending about the periphery of said bottom panel, said peripheral panel defining a pair of opposing side walls which extend between and connect a pair of opposing end walls, said side walls and said end walls having a top portion, an exterior surface, and an interior surface;

a first pair of hook-and-loop fastening patches attached to the interior surface of said opposing side walls;

a detachable fastening strap, said strap having opposing ends the opposing ends having a second pair of hook-and-loop fastening patches affixed thereto, said second pair of hook-and-loop fastening patches mating with said first pair of hook-and-loop fastening patches in order to detachably attach said strap to said opposing side walls;

a handle attached to the top portion of each of said opposing side walls;

a pair of interior pockets fixedly attached to the interior surface of said side walls, each of said interior pockets formed as an envelop enclosure and having a zippered flap for securing items contained therein;

an exterior panel attached to the exterior surface of each said end wall and each said side wall for forming a plurality of exterior pockets on each of said side walls and at least one pocket on each of said end walls, said exterior pockets having a mouth portion facing said top portion; and an elastic fastening band, said elastic fastening band attached to an exterior of said peripheral panel above said mouth portion for securing items contained in each exterior pocket;

wherein said bottom panel and said peripheral panel together form a container having an interior compartment area for storing tools of a crafter; and said bottom panel supports the purse on a horizontal support surface.

2. The purse, for storing, displaying, accessing and carrying craft tools, of claim 1, wherein said side walls and said end walls are integrally connected.

3. The purse, for storing, displaying, accessing and carrying craft tools, of claim 1, wherein said purse is made from fabric.

4. The purse, for storing, displaying, accessing and carrying craft tools, of claim 3, wherein said fabric is canvas.

5. The purse, for storing, displaying, accessing and carrying craft tools, of claim 1, wherein said exterior panel attached to each said side wall includes three exterior pockets and the exterior panel attached to each said end wall includes one exterior pocket.

* * * * *